United States Patent [19]

Steinman et al.

[11] Patent Number: 4,951,172

[45] Date of Patent: Aug. 21, 1990

[54] METHOD AND APPARATUS FOR REGULATING AIR IONIZATION

[75] Inventors: Arnold J. Steinman; Michael G. Yost, both of Berkeley, Calif.

[73] Assignee: Ion Systems, Inc., Berkeley, Calif.

[21] Appl. No.: 221,779

[22] Filed: Jul. 20, 1988

[51] Int. Cl.[5] ..... H05F 3/06

[52] U.S. Cl. ..... 361/213; 361/231; 361/235

[58] Field of Search ..... 361/212, 213, 229, 230, 361/231, 233, 235; 250/324, 325, 326; 55/105, 123, 139; 307/350, 355, 359, 264

[56] References Cited

U.S. PATENT DOCUMENTS

| | | | |
|---|---|---|---|
| 2,264,495 | 12/1941 | Wilner | 361/231 |
| 3,624,448 | 11/1971 | Saurenman | 361/231 |
| 3,936,698 | 2/1976 | Meyer | 361/231 |
| 4,542,434 | 9/1985 | Gehlke et al. | 361/231 |
| 4,630,167 | 12/1986 | Huggins | 361/213 |
| 4,757,422 | 7/1988 | Bossard et al. | 361/231 |
| 4,809,127 | 2/1989 | Steinman et al. | 361/213 |

OTHER PUBLICATIONS

R. H. Dunphy et al., "A Computer Controlled Air Ionizing System", date not known but prior to Oct. 17, 1985.

Voyager Technologies, Inc., "Computer Controlled Air Ionization", Date not known but prior to Oct. 17, 1985.

*Primary Examiner*—A. D. Pellinen
*Assistant Examiner*—David Osborn
*Attorney, Agent, or Firm*—Phillips, Moore, Lempio & Finley

[57] ABSTRACT

Ion content of the atmosphere at a particular location is controlled by generating ions during repetitive period that are initiated by timing signals which reoccur at a predetermined rate. An ion sensor produces feedback signals indicative of the ion content of the air and a feedback circuit varies the duration of the recurring periods of ion generation, if necessary, to maintain the ion content within a predetermined range. Positive and negative ions may be generated during alternate ones of the repetitive periods in which case the feedback circuit inversely varies the periods of positive and negative ion generation to maintain the relative proportions of the two types of ion within a predetermined range. The method and apparatus may be used to suppress accumulation of electrostatic charge by objects, such as in a clean room where electronic components are manufactured, or for other purposes requiring control of the ion content of air.

18 Claims, 5 Drawing Sheets

FEEDBACK MODULE
CONTROL CONSOLE 16
137
29a
13a
138
+
−
28a
17
11a
14
34
13
12
31
32
19
11
18
33
36

FEEDBACK MODULE
CONTROL CONSOLE
AC

METHOD AND APPARATUS FOR REGULATING AIR IONIZATION

TECHNICAL FIELD

This invention relates to methods and apparatus for ionizing air and more particularly to the control of air ionizers for the purpose of maintaining a predetermined ion content in the air at a particular region in order to suppress static electrical charges or for other purposes.

BACKGROUND OF THE INVENTION

Accumulations of static electrical charge can cause a variety of adverse effects. Discharges of static electricity are discomforting to people and can disrupt the operation of electronic equipment such as computers. Problems with static charge build-up have become particularly acute in certain industrial operations of which the manufacture of miniaturized solid state electronic components is a prominent example.

Discharges of static electricity can destroy the minute conductive paths in microchip wafers or the like. Charge accumulations on such wafers or the like also attract particulate contaminants which can cause the product to become defective.

Maintaining a high level of air ionization in the vicinity of objects which are to be protected is a highly effective technique for suppressing static charge build-up in clean rooms where electronic components are manufactured or at other locations. Charge accumulations on objects attract air ions of opposite polarity which then neutralize the charge.

Most air ionizing systems have one or more sharply pointed electrodes to which high voltage is applied. The resulting intense electrical field near the point of the electrode dissociates molecules of the constituent gases of air into positively and negatively charged ions. Ions having a polarity or charge opposite to that of the electrode are attracted to the electrode and neutralized. Ions of similar polarity are repelled by the electrode and by each other and disperse outwardly into the surrounding air. Ion movement from the electrode to the region of objects that are to be protected is usually accelerated by providing an air flow from the electrode to the object region.

Air ionizing systems intended for static charge suppression are usually designed to generate both positive and negative ions as the charges to be suppressed may be of either polarity. This may be accomplished by using two electrodes having opposite voltages or by periodically reversing the voltage on a single electrode. Production of both types of ion simultaneously tends to reduce the effective range of the apparatus as intermixed positive and negative ions rapidly neutralize each other by charge exchange.

Prior U.S. Pat. No. 4,542,434 of Scott J. S. Gehike et al, issued Sept. 17, 1985 and entitled "Method and Apparatus for Sequenced Bipolar Air Ionization" (assigned to the assignee of the present application) describes a method and apparatus which extends the range of bipolar air ionizers and offers other advantages as well. In the system of that patent, timing signals initiate positive and negative ion generation at spaced apart electrodes during alternate time periods which are separated by off intervals during which no ion generation occurs. This allows an air flow to carry each pulse of ions a substantial distance away from the electrodes before significant intermixing and mutual neutralization of the two types of ions begins.

Precise control of the ion output rate is desirable in apparatus of the above described kind. Effective static charge suppression at a particular location requires that the ratio of positive to negative ions be within a narrow range of values and that the total concentration of ions in the air also be at or close to an optimum value. An excess of ions of one polarity can have the counter-productive effect of imparting charge to objects. A low concentration of ions may not adequately neutralize static charges and an overly high concentration may also have adverse effects. The optimum ratio of positive to negative ions and the optimum total ion concentration that are needed vary from location to location. The optimum ratio and concentration may also vary at a particular location over a period of time because of changes in activities, equipment, air flow patterns or other conditions at the location. The air ion content at the location can also depart from the desired levels because of changes in the ionizing apparatus itself such as electrode deterioration from corrosion, utility power line voltage fluctuations or other causes.

Thus the air ionizing apparatus should enable separate adjustment of the rates of generation of both positive and negative ions and the ion content of the air at the location should be monitored so that readjustments can be made when changed conditions make that advisable.

In the system of the above identified U.S. Pat. No. 4,542,434, positive and negative electrode voltages, the timing of periods of positive and negative ion generation and the duration of the off periods between periods of ion generation can each be independently adjusted. This enables tuning of the system to provide a ratio of positive to negative ions and a total ion concentration that is suited to the needs of the particular location where the system is installed. Ion levels at the site can then be monitored with sensing instruments and manual readjustments can be made when changed conditions make that necessary. It would be advantageous if the monitoring and readjustment process were accomplished automatically and on a continuous basis. The system may then respond more quickly to a sudden change in conditions that calls for a change in the output rate of ions of a particular polarity or of both polarities.

Feedback systems have heretofore been devised for the purpose of automatically adjusting the ion output rate of air ionizers to maintain a desired air ion content under changing conditions. One or more ion sensing devices produce signals indicative of changes in the ion content of the air. A feedback circuit then varies the high voltage on the ionizing electrode in response to changes in the signal to maintain the ion content at the preferred level.

Copending U.S. patent application Ser. No. 085,082 of Arnold J. Steinman et al filed Aug. 11, 1987 and entitled "Self-Regulating Ion Emitter" (assigned to the assignee of the present invention and now issued as U.S. Pat. No. 4,809,127) discloses a feedback system which varies electrode voltage in response to internally sensed variations of ion output rather than in response to an external ion sensor.

The extent to which such feedback systems can compensate for changes in the ion content of the air is dependent on the range of adjustment of electrode voltage that is available. The available range of electrode voltages also limits the speed of response to a sudden depletion of the ion content in the air. An undesirably long time may be needed for restoration of the preferred ionization level.

The range of adjustment of ion output cannot, as a practical matter, be extended simply by providing a high voltage source that can produce higher voltages. Electrode voltages exceeding about 20,000 volts would cause an undesirable generation of ozone and problems with arcing would become severe. Thus air ionizing systems have a maximum operating voltage that is below that level.

The effects of the limited range of voltage adjustment are more pronounced in the case of air ionizers of the above described cyclical type which do not generate ions continuously, but operate instead on a pulsed basis, off periods being alternated with the intervals of ion generation. As the generation of ions of a particular polarity occurs only intermittantly, a longer period of time is needed to correct a sudden depletion of ions of that polarity with the ionizer operating at maximum voltage.

Thus it would be advantaqeous to enable feedback control of pulsed or cyclically operated air ionizers in a manner that is not limited by the above described constraints imposed by the maximum available voltage.

The present invention is directed to overcoming one or more of the problems discussed above.

SUMMARY OF THE INVENTION

In one aspect, the present invention provides a method of maintaining a desired concentration of ions in the atmosphere at a predetermined location. Steps in the method include generating a cyclical first timing signal that alternates between first and second signal conditions, generating ions of a predetermined polarity in the atmosphere during periods that occur while the first timing signal is at the first signal condition and at least reducing the rate of generation of ions of the predetermined polarity during intervals that occur while the timing signal is at the second signal condition. Further steps include producing a feedback signal that is indicative of variations of ion concentration at the predetermined location and varying the duration of the periods of ion generation in response to variations of the feedback signal to maintain the desired concentration of ions at the predetermined location.

In another aspect, the invention provides a method for suppressing the accumulation of electrostatic charges by objects at a predetermined location which includes the step of producing timing signals which define a sequence of positive ion generation periods that reoccur at a predetermined rate and which define a sequence of negative ion generation periods that also reoccur at the predetermined rate, the positive ion generation periods being alternated with the negative ion generation periods Positive and negative air ions are alternately generated in response to the timing signals. Further steps in the method include producing a feedback signal by sensing changes in the ion content of the air at the location and varying the duration of the periods of positive ion generation and inversely varying the duration of the periods of negative ion generation to maintain the feedback signal within a predetermined range of values.

In still another aspect, the invention provides apparatus for maintaining a desired concentration of ions in the atmosphere at a predetermined location, the apparatus having at least one ionizing electrode, timing means for generating a first cyclical timing signal that alternates between first and second signal conditions, and means for applying high voltage of a predetermined polarity to the electrode during ion generating periods that occur while the first signal is at the first signal condition and for at least reducing the voltage on the electrode during intervals that occur while the timing signal is at the second signal condition. Further components include sensing means for producing a feedback signal that is indicative of variations of ion concentration at the predetermined location and feedback means for varying the duration of the periods of generation of ions of the predetermined polarity in response to variations of the feedback signal to maintain the ion content of the atmosphere at the location within the predetermined range.

In another aspect, the invention provides apparatus for suppressing the accumulation of electrostatic charges by objects at a predetermined location which includes an electrical pulse generator for producing timing signals that define a sequence of positive ion generation periods that reoccur at a predetermined rate and that also define a series of negative ion generation periods that also reoccur at the predetermined rate, the positive ion generation periods being alternated with the negative ion generation periods. The apparatus further includes air ionizing means for alternately initiating generation of positive and negative air ions in the vicinity of the location in response to the timing signals. An ion sensor has means for producing a feedback signal that is indicative of changes of the net polarity of the ion content of the atmosphere at the location. A feedback circuit of the apparatus has means for varying the duration of the periods of positive ion generation and for inversely varying the duration of the periods of negative ion generation to maintain the feedback signal within a predetermined range of values.

The invention provides a feedback method and apparatus for air ionizers of the type in which ion generation is pulsed or cyclical. A preferred concentration of ions is maintained in the surrounding air under changing conditions by sensing departures of the ion concentration from the preferred value and then varying the duration of the cyclical periods of ion generation as needed to restore the preferred value. In bipolar systems which generate positive and negative ions during alternating time periods, the invention also enables automatic control of the concentrations of both types of ion to maintain a substantially constant ratio of positive and negative ions varying the duration of the repetitive ion generation periods enables fast restoration of the preferred ion content in air when changes are sensed and this in turn provides for a more precise control of the ion content with pulsed ionizing systems. When used in conjunction with a feedback system of the type that varies electrode voltage to stabilize the ion content of air, the invention extends the available range of adjustment of ion output rate beyond the range that is otherwise imposed by the upper voltage limit of the high voltage supply.

DETAILED DESCRIPTION OF THE PREFERRED EMBODIMENTS

Figures 1, 4:
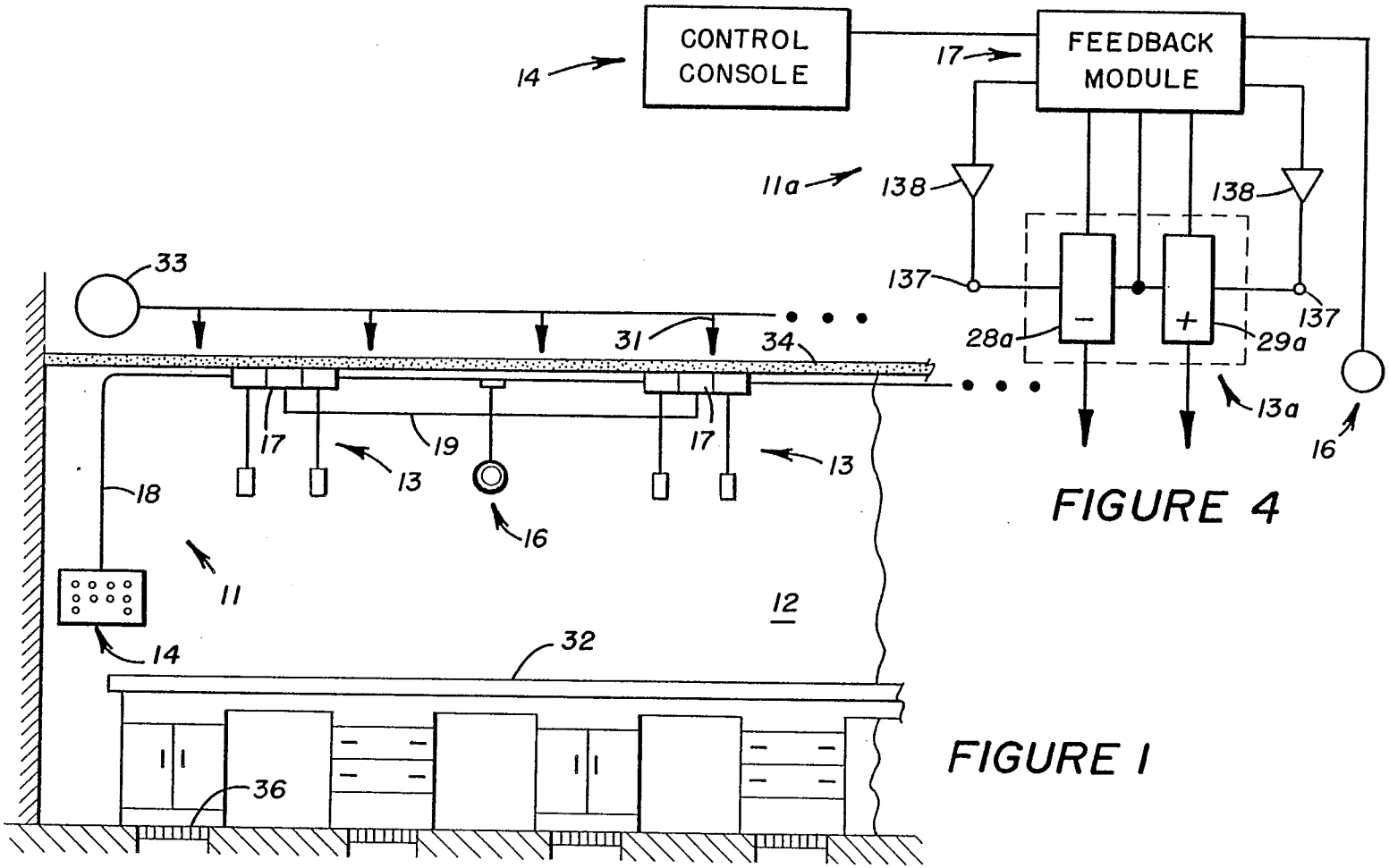
FIG. 1 is an elevation section view depicting an embodiment of the invention installed in a clean room of the type in which electronic circuit components are processed.
FIG. 4 is a schematic circuit diagram of a modification of the apparatus in which two forms of ion output rate adjustment interact to extend the available range of output rates.

Referring initially to FIG. 1, air ionizing apparatus 11 in accordance with this embodiment of the invention is shown, for purposes of example, as an installation in a clean room 12 in which electronic components are manufactured and in which significant accumulations of electrostatic charge are to be suppressed to avoid damage to the products. Similar ionizing apparatus 11 may be used at other locations where static charge suppression is needed or where control of the ion content of the atmosphere is desirable for other purposes.

Major components of the ionizing apparatus of FIG. 1 include one or more ion emitter units 13 which are typically secured to the ceiling of the room 12, a control console 14 which may, for example, be attached to a wall of the room at an accessible location, one or more ion sensors 16 that are located to be exposed to the air in the room such as by being suspended from the ceiling in this example and one or more feedback modules 17 which are preferably located close to the emitter units 13. A four conductor electrical cable 18 connects the control console 14 with each of the emitter units 13 and one or more additional four conductor cables 19 connect each sensor 16 with one or more of the feedback modules 17 as will hereinafter be described in more detail.

The emitter units 13 may be of the construction described in the above identified U.S. Pat. No. 4,542,434. Thus, with reference to FIG. 2, each emitter unit 13 has a housing 21 from which two spaced apart insulative tubes 22 and 23 extend downward. Needle shaped ionizing electrodes 24 and 26 are situated at the lower ends of tubes 22 and 23 respectively and extend axially within cylindrical guards 27, the pointed ends of the electrodes being exposed to the surrounding air.

Housing 21 contains a negative high voltage supply 28 which is connected to electrode 24 through tube 22 and a positive high voltage supply 29 connected to electrode 26 through tube 23. The high voltage supplies 28 and 29 may be voltage amplifiers of the known form that rectify, smooth and amplify a low voltage alternating input current to provide a D.C. high voltage output that can be varied by changing the input voltage.

High voltage supplies 28 and 29 are actuated alternately by the control console 14 as will hereinafter be described in more detail and under most operating conditions the resulting alternate periods of positive and negative ion generation at electrodes 26 and 24 are separated by periods of no ion generation. Consequently the pulses of ions of each polarity may disperse away from the electrode 24 or 26 for a substantial distance before intermixing of the two types of ions occurs. This delays the process of mutual neutralization by charge exchange and allows the apparatus 11 to maintain a high level of air ionization at locations which may be a substantial distance away from the emitter units 13.

Referring again to FIG. 1, an air flow 31 is usually provided to speed the travel of ions from the emitter units 13 to the region, work table 32 in this instance, where static charge accumulations are to be suppressed. In a typical clean room 12, a fan 33 forces the air flow 31 downward through porous ceiling members 34. The air flow 31 may leave the room through gratings 36 at the floor. The air flow 31 aids in maintaining a high level of air ionization at work table 32 as it decreases the travel time of ions to the work table and thereby reduces ion losses from charge exchange between the positive and negative ions.

While only two emitter units 13 are depicted in FIG. 1, a larger number are usually provided in a typical clean room 12. The emitter units 13 are typically arranged in an array with the units being several feet apart. The spacing of emitter units 13 need not necessarily be uniform as units may be situated over particular locations where problems with static charge are particularly pronounced.

Each emitter unit 13 may be provided with its own sensor 16 and feedback module 17 where very precise regulation of air ion content is needed but this is not necessary in many cases. In some instances a single sensor 16 and feedback module 17 may be connected to all emitter units 13 or a single sensor and module may be connected to a group of nearby emitter units. Ideally, the sensor 16 is situated at the location where static charge suppression is most critical, work table 32 in this instance, but often that is not practical because of the risk of damage or disturbance that could alter the sensor signal. The sensor 16 should be at a location where those risks are not present and in this example, the sensor is suspended from the ceiling of room 12 approximately at the elevation where ion generation occurs. The sensor 16 should be located away from the immediate vicinity of the emitter units 13 as there is minimal intermixing of positive and negative ions at that location and air ion content at that region is not closely representative of conditions at the work table 32. The construction and and operation of the sensor 16 will be hereinafter described.

Referring again to FIG. 2, the control console 14 generates timing signals which actuate high voltage supplies 28 and 29 during alternating time periods that are separated by time periods during which both high voltage supplies are off. The circuit of console 14 further enables independent selection of the duration of the periodic actuation of high voltage supply 28, the duration of the alternating actuations of high voltage supply 29 and the duration of the off periods between actuations so that the ion output of the apparatus 11 can be adjusted to meet the needs of the particular location where it is installed.

In particular, the control console 14 has a voltage step-down transformer 37 with a primary winding 38 that is connected to utility power input terminals 39 through an on-off switch 41 and a protecting fuse 42. A varistor 43 is connected in parallel with primary winding 38 to protect the circuit from power line surges and transients.

Transformer 37 reduces the voltage of the utility line alternating current to a value of 48 volts in this example. Such voltage step down is advantageous although not essential, as it enables use of light low cost electrical cabling 18 to connect the console 14 and emitter units 13.

The secondary winding 44 of transformer 37 is connected between first and second low voltage power conductors 45 and 46 respectively which extend on through cable 18 to the emitter units 13. Conductors 45 and 46 supply operating current to certain components of the emitter units 13 and feedback modules 17 as will hereafter be further described.

A first Variac or adjustable autotransformer 47 is connected between low voltage conductors 45 and 46 to enable selection of the A.C. voltage that is applied to the negative high voltage generators 28. This in turn enables adjustment of the maximum output rate of negative ions that will occur during periods of negative ion generation. The adjustable output tap 48 of autotransformer 47 connects with the emitter units 13 through a first normally open solid state relay 49 and another conductor 51 of cable 18.

A second similar autotransformer 52 is connected between low voltage conductors 45 and 46 to provide for selection of the maximum output rate of positive ions during the periods of positive ion generation. The adjustable tap 53 at the output of autotransformer 52 connects with the emitter units 13 through a second normally open solid state relay 54 and still another conductor 56 of cable 18.

The relays 49 and 54 are periodically closed in an alternating manner, to alternately actuate the negative and positive high voltage generators 28 and 29, by timing signals 57 and 58 respectively from a pulse generator 59 of the known form that produces pulsed signals of selectable wave shapes. A suitable detailed circuit for an adjustable pulse generator 59 of this type is described, for example, in the hereinbefore identified U.S. Pat. No. 4,542,434 at column 9, line 64 to column 12, line 11, of that patent.

Timing signal 57 alternates between a first signal condition that actuates the negative high voltage supplies 28 and a second signal condition at which those high voltage supplies are off. Timing signal 58 similarly alternates the first and second signal conditions to periodically actuate the positive high voltage supplies 29 during intervals when the negative high voltage supplies are off. Intervals when one or the other of the two timing signals are in the first signal condition are separated by intervals when both signals are in the second signal condition and all high voltage supplies 28 and 29 are off.

A pair of signal conductors 61 and 62 of pulse generator 59 connect with a D.C. power supply 63 through the driver circuits of relays 49 and 54 respectively. The pulse generator 59 generates the above described timing signals 57 and 58 by periodically grounding each signal conductor 61 and 62 in an alternating relationship. Thus the relays 49 and 54 are alternately closed to cause the alternating actuations of the negative and positive high voltage supplies 28 and 29. Manually adjustable controls 64 of a pulse generator of the above described type enable separate adjustment of the duration of the cyclical periods of negative ion generation, the duration of the off times that follow negative ion generation, the duration of the cyclical periods of positive ion generation and the duration of the off times that follow positive ion generation. As will be apparent from the following description of the feedback process, these preselected durations are in effect maximum durations as the feedback operations act to adjust the periods of ion generation in order to regulate air ion content under changing conditions.

Direct current operating voltage for the pulse generator 59 and relays 49 and 54 is provided by the D.C. power supply 63 which is connected in parallel with the primary winding 38 of input transformer 37. A high resistance 66 is connected across the primary and secondary windings 38 and 44 of input transformer 37 to enable cable conductor 46 to function as a common or chassis ground conductor for the emitter units 13, sensors 16 and feedback modules 17.

Figure 3:
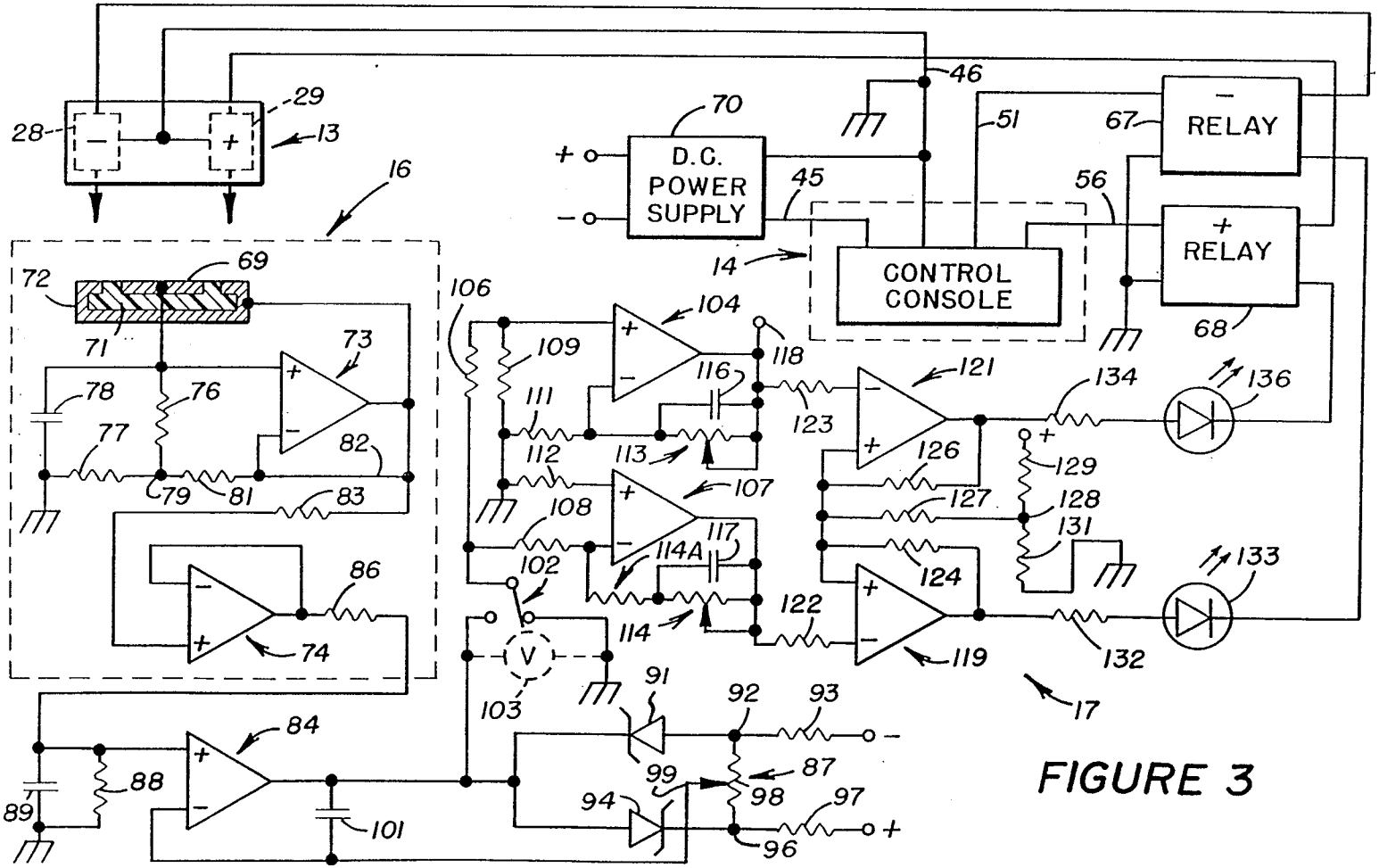
FIG. 3 is a circuit diagram of the ion sensor and also the feedback circuit of the apparatus of the preceding figures.

Referring now to FIG. 3, the previously described cable conductor 51 which periodically transmits actuating current for the negative high voltage supply 28 of emitter unit 13 is coupled to that high voltage supply through a a first normally open relay 67 of feedback module 17. The cable conductor 56 providing actuation current for the positive high voltage supply 29 is coupled to that supply through a second similar relay 68. The cable conductor 46 which defines a chassis ground for the feedback module 17, ionizing unit 13 and sensor 16 is directly connected to the high voltage supplies 28 and 29. Ground symbols in FIG. 3 designate a conductive connection to cable conductor 46.

A direct current power supply 70 in the feedback module 17 is connected across the low voltage alternating current conductor 45 and common or chassis qround conductor 46 to provide positive and negative D.C. voltages, each of 15 volts magnitude in this example, for operating the hereinafter described components of the feedback module and sensor 16 that require D.C. operating current.

If relays 67 and 68 are caused to be continuously closed, which is an optional mode of operation in this embodiment as will hereinafter be further described, the system is not subject to feedback control and operates essentially as described in prior U.S. Pat. No. 4,542,434. The durations of the periods of positive and negative ion generation and of the off periods between ion generation are constant as fixed by the previously described adjustments at the timing signal pulse generator 59 of FIG. 2. Referring again to FIG. 3, the relays 67 and 68 enable feedback circuit 17 to vary the durations of these periods in response to an air ion content signal from sensor 16.

The sensor 16 of this example has a circular conductive disc 69 secured to one face of a circular insulative printed circuit board 71. Board 71 is disposed within a conductive shield 72 which also encircles the periphery of disc 69 in spaced apart relationship from the disc. Circuit components of the sensor 16, such as amplifiers 73 and 74 are shown by symbols in FIG. 3 to facilitate understanding of the circuit but are actually mounted on the circuit board 71 within shield 72. Sensors 16 having other configurations may also be used. A v-shaped plate or a cylinder may, for example, be substituted for the disc 69.

Disc 69 is connected to chassis ground through a high resistance 76 and a relatively small resistance 77 connected in series relationship. A capacitor 78 is also connected between the disc 69 and ground. Thus an imbalance of positive or negative air ions at the surface of disc 69 results in a current flow through resistors 76 and 77 and a voltage drop across resistor 76 that is indicative of the magnitude and polarity of the imbalance. The positive or non-inverting input of amplifier 73 is connected to disc 69 and the negative or inverting input of the amplifier is connected to the output of the amplifier and also to the circuit junction 79 between resistors 76 and 77, through a resistor 81. Thus a feedback signal voltage is generated which changes in response to changes of the voltage drop across resistor 76.

As resistor 81 is connected to the junction 79 rather than directly to ground, the amplifier 73 is in the so called bootstrap configuration which results in a multiplication of the effective resistance of resistor 76 by the ratio of the value of resistor 77 to the value of resistor 81.

Capacitor 78 and the multiplied resistance of resistor 76 defines an integrating circuit which provides a limited degree of signal integration so that the response of the sensor 16 to changing ion ratios matches that of an ionization detector instrument that is used to initialize the adjustments of the ionizing apparatus as will hereinafter be described. In this particular example, the values of resistors 76, 77, 81 and capacitor 78 are selected to provide an effective time constant of 200 seconds. This time constant enables fast response to changes of ion content in the air.

Amplifier 73 exhibits unity gain as the output is fed back to the negative input through a conductive path 82 that has no significant resistance. The output of amplifier 73 is also connected to the sensor shield 72 to assure that the shield is always at the same voltage as disc 69. This avoids any flow of leakage current, which could distort the feedback signal, between the disc 69 and shield 72.

The feedback signal is transmitted from the sensor 16 to the feedback module 17 through a buffer amplifier 74. The output voltage from integrator amplifier 73 is applied to the positive input of buffer amplifier 74 through a resistor 83 and the output of the buffer amplifier is fed back to the negative input. Thus the buffer amplifier 74 has unity gain in this example although amplifiers having other gain values may also be used.

The feedback signal voltage from the output of buffer amplifier 74 is transmitted to the positive input of a D.C. level shifting amplifier 84 of the feedback module 17 through a resistor 86. The D.C. level of the feedback signal voltage from sensor 16 may not be symmetrical about the zero level but may instead be biased towards a positive or negative mean voltage level. This can occur if the sensor 16 is not symmetrically located relative to the positive and negative ionizing electrodes 24 and 26, because of the proximity of grounded objects, or if a preponderance of ions of one polarity has been deliberately selected or for other reasons. Amplifier 84 in conjunction with a manually adjustable potentiometer 87 enables the feedback signal voltage to be balanced about the zero level.

In particular, a signal integrating resistor 88 and capacitor 89 are connected between the positive input of amplifier 84 and chassis ground. The amplifier output connects to the negative D.C. power supply terminal through a a zener diode 91, a circuit junction 92 and a resistor 93 and is also connected to the positive power supply terminal through another zener diode 94, another circuit junction 96 and another resistor 97. Diode 91 transmits positive current away from the output of amplifier 84 when the amplifier output voltage reaches a predetermined positive value in relation to the voltage at junction 92 and zener diode 94 transmits positive current towards the amplifier 84 output when the output voltage reaches a predetermined negative level in relation to the voltage at circuit junction 96. The resistive element 98 of potentiometer 87 is connected across junctions 92 and 96 and the movable tap 99 of the potentiometer connects to the negative input of amplifier 84. A capacitor 101 is coupled between the output and negative input of the amplifier.

The output of amplifier 84 is coupled to further components of the feedback module 17 through a mode control switch 102. During the initial adjustment of the system, switch 102 is positioned to decouple the amplifier 84 from such further components to deactivate the feedback process. A voltmeter 103 or other voltage monitor is then temporarily connected between ground and the output of amplifier 84. Potentiometer 87 may then be adjusted to change the reference voltage that is applied to the negative input of amplifier 84 until voltmeter 103 indicates that the feedback signal level has been shifted into symmetry about the zero voltage level.

Under most conditions, the feedback signal from amplifier 84 oscillates between positive and negative voltage levels in response to the alternating periods of positive and negative ion generation. The feedback circuit 17 responds to a positive or negative voltage level that that exceeds a pre-selected value by shortening the duration of the periods of generation of ions of that polarity and by extending the duration of the periods of generation of ions of opposite polarity. This holds the ratio of positive to negative ions at the work site and the concentration of each type of ion at the work site within a narrow range of values.

For this purpose, the feedback signal voltage from the output of amplifier 84 is transmitted to the positive input of a non-inverting amplifier 104 through mode selector switch 102 and an input resistor 106 and is also transmitted to the negative input of an inverting amplifier 107 through the switch and another input resistor 108. The positive input and negative inputs of amplifier 104 and the positive input of amplifier 107 are each connected to ground through separate resistors 109, 111 and 112 respectively.

Amplifiers 104 and 107 each have a variable gain to enable selection of the positive and negative feedback signal voltage levels that trigger shortening of the periods of generation of ions of corresponding polarity. For this purpose, manually adjustable variable feedback resistors 113 and 114 are connected between the outputs and negative inputs of amplifiers 104 and 107 respectively. An additional resistor 114A, connected in series with resistor 114 at the inverting amplifier 107, serves to match the gain of the inverting amplifier with that of the non-inverting amplifier 104 at the minimum settings of variable resistors 113 and 114.

Feedback resistors 113 and 114 are bridged by capacitors, 116 and 117 respectively which filter out any alternating current fluctuation that may be picked up by the D.C. components of the circuit. A terminal 118 is coupled to the output of amplifier 104 to provide for optional connection of an alarm and shut-down circuit as will hereinafter be described.

Relays 67 and 68 are controlled, to vary the periods of negative and positive ion production, by a pair of comparator amplifiers 119 and 121 respectively. The negative inputs of amplifiers 119 and 121 are coupled to the outputs of amplifiers 107 and 104 respectively through separate input resistors 122 and 123 respectively. Each amplifier 119 and 121 has a feedback resistor, 124 and 126 respectively, connected between the output and positive input. A fixed positive voltage is applied to the positive inputs of both comparator amplifiers 119 and 121 through a single resistor 127 which connects to a circuit junction 128. Junction 128 is connected to the +terminal of D C. power supply 70 through a resistor 129 and to ground through another resistor 131 and thus the fixed voltage that is applied to the positive inputs of amplifiers 119 and 121 is smaller than the maximum available voltage.

The output of comparator amplifier 119 switches from a relatively high voltage level to a lower level at times when the adjusted feedback signal voltage from amplifier 104 rises to equal or exceed the fixed voltage at the positive input of the comparator amplifier. The output of the comparator amplifier 119 is connected to ground through an output resistor 132, a light emitting diode 133 and the driver circuit of relay 67.

The high voltage level output from comparator amplifier 119 closes the relay 67 enabling the transmission of alternating current from control console 14 to the negative high voltage supply 28. The lower level output from amplifier 119 is not high enough to actuate the relay 67 and consequently the relay opens when a rising positive feedback signal causes the output of comparator amplifier 119 to go low. This blocks the alternating current from negative high high voltage supply 28.

Thus, in operation, each period of negative ion generation that is initiated by the control console 14 is terminated, by opening of relay 67, when sensor 16 detects that the concentration of negative ions in the air has risen to the pre-selected limit. The durations of successive periods of negative ion generation may be increased or decreased in this manner by the feedback system to maintain a substantially constant negative ion concentration.

The other comparator amplifier 121 is connected to ground through another output resistor 134, another light emitting diode 136 and the driver circuit of relay 68. Thus the positive ion concentration in the work site atmosphere is maintained substantially constant in a manner similar to that described above with respect to negative ion control.

Light emitting diode 133 is periodically energized when the output of comparator amplifier 119 goes high and diode 136 is energized at the alternating periods when the output of amplifier 121 is high. Thus the diodes 133 and 136, which may be situated at a visible location on the outside surface of the feedback module 17, alternately emit light and enable observers to visually monitor the operation of the system. In extreme situations where the demand for ions of one polarity may exceed the capacity of the apparatus to generate such ions, the feedback system reacts by essentially stopping generation of ions of the opposite polarity. This situation is made apparent to observers in that one of the diodes 133, 136 will blink only momentarily while the other remains lit for abnormally long periods.

The mode selector switch 102 of this embodiment has a first position at which the feedback signal from amplifier 84 is transmitted on to amplifiers 104 and 107 to enable operation of the feedback system as described above. Switch 102 has another position at the which the positive and negative inputs of amplifiers 104 and 107 respectively are disconnected from amplifier 84 and grounded. This inactivates the feedback system and the ionizing apparatus reverts to the mode of operation described in prior U.S. Pat. No. 4,542,434. Relays 67 and 68 are continually in the closed state and periods of positive and negative ion generation are then of fixed duration as determined by the settings at control console 14.

During start up of the ionizing apparatus 11 at a particular location the mode selector switch 102 is temporarily set at the feedback off position and the ion content of the air at the location is detected with a charged plate monitor or other ion detector. Referring again to FIG. 2, the several controls 48, 53 and 64 of the control console 14 are then adjusted until it is observed with the monitor that the desired air ion content is present and that any cyclical variation in the ratio of positive to negative ions at the work site, caused by the alternating periods of positive and negative ion production, is within acceptable limits. A voltage oscillation on ungrounded conductors at the work site that is limited to the range of about +100 volts to about −100 volts will not usually cause any adverse effects from static electricity discharges and in many cases a wider voltage swing is tolerable.

After the above described tuning of the system to meet the needs of the particular installation, the timing signal controls 64 of pulse generator 59 are readjusted to extend the duration of the periodic portions of the timing signals 57 and 58 that call for ion generation. This provides an operating range within which the feedback process can vary the periods of ion generation as previously described if conditions change and longer ion generation periods are needed. This readjustment also has the effect of temporarily enlarging the cyclical variation of the positive to negative ion ratio which effect is counteracted in the manner hereinafter discussed.

Referring again to FIG. 3, potentiometer 87 is then adjusted as previously described to center the feedback signal voltage level about the zero level and the mode selector switch 102 is changed to the feedback on position. The gains of amplifiers 104 and 107 are then adjusted at variable feedback resistors !13 and 114 to counteract the temporary enlargement of the variation of positive to negative ion ratio. Raising the gain of either amplifier 104 or 107 causes it to trigger the associated comparator 121 or 119 in response to a smaller rise in the feedback signal.

The ionizing apparatus 11 then operates in the manner previously described to maintain the selected concentrations of both positive and negative ions in the air at the work site under changing conditions where variations in the output rate of one or both types of ion may be needed to accomplish that objective.

The feedback process of the above described embodiment of the invention varies the ion output rate solely by varying the durations of the periods of ion generation. Electrode voltage remains constant at a preselected value. This feedback method can also be advantageously combined with other known feedback methods that vary ion output rate by changing the voltage on the ionizing electrodes as needed for the purpose. This results in an available range of ion output rates that exceeds the capabilities of either method acting alone.

With reference to FIG. 4, ionizing apparatus **11*a* combining the two feedback techniques can be largely similar to the previously described apparatus insofar as the control console 14, sensor 16 and feedback module 17 are concerned. The emitter units 13*a* differ in that the negative and positive high voltage supplies 28*a* and 29*a*** respectively are variable gain high voltage amplifiers of the known form which adjust the output voltage in response to variations of a control signal voltage that is applied to a control terminal 137 of the high voltage amplifier.

Feedback module 17 varies the duration of periods of ion generation, if necessary, in the manner previously described. In addition, the adjusted negative and positive feedback signal voltages are transmitted from the feedback module 17 to the control terminals 137 of the negative and and positive high voltage supplies 28*a* and 29*a* respectively. The adjusted positive and negative feedback signal voltages may be obtained at the outputs of amplifiers 104 and 107 respectively of FIG. 3. Referring again to FIG. 4, the feedback signal voltages may be transmitted from feedback module 17 to control terminals 137 through adjustable gain amplifiers 138 which enable adjustment of the signal levels to match the requirements of the high voltage supplies 28*a* and 29*a*.

While the embodiment of FIG. 4 uses the same sensor 16 and feedback module 17 to control both modes of control of the high voltage supplies 28*a*, 29*a*, it is also possible to use a separate sensor and feedback system to provide control signals to terminals 137.

The method and apparatus of the present invention can make use of ion sensors 16 of any of a variety of different constructions and can also operate from feedback signals that indicate changes in ion output rate of the apparatus. For example, with reference to FIG. 5, the generation of air ions of a given polarity at a high voltage electrode 24 or 26 is necessarily accompanied by a return current flow of electrical charges of opposite polarity back to the ground conductor 46 which connects to the high voltage supply 28 or 29. The return current flow is proportional to the rate of ion generation and varies if the ion output rate varies. Copending U.S. patent application Ser. No. 085,082 of Arnold J. Steinman et al filed Aug. 11, 1987 and entitled "Self-Regulating Ion Emitter" (assigned to the assignee of this present application) discloses a system which senses changes in the return current and varies the voltage of the ionizing electrodes 24 and 26 in order to maintain a constant predetermined ion output rate. The present invention may be used to accomplish a similar result by varying the periods of ion generation instead of electrode voltage or by varying both.

Figure 2:
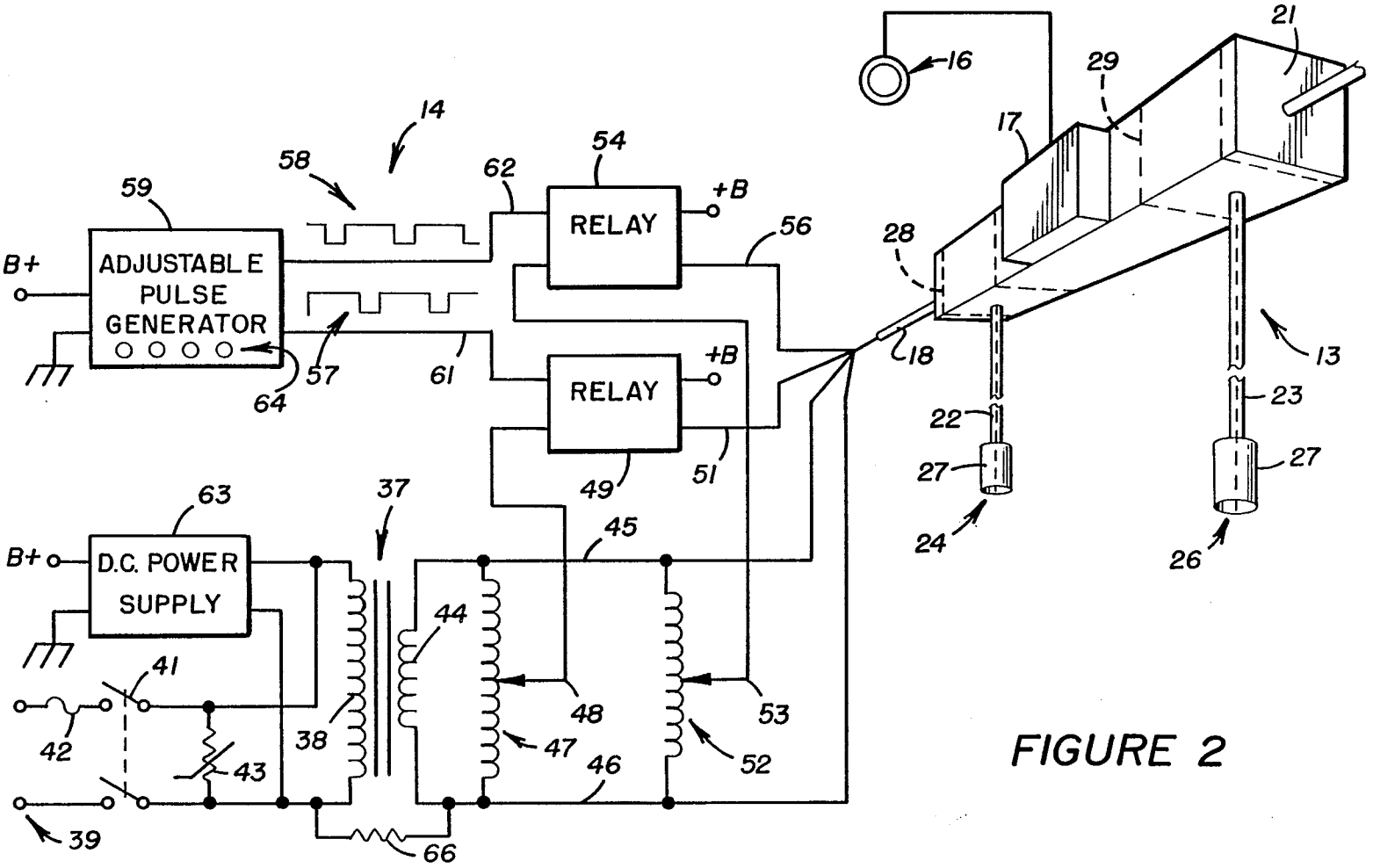
FIG. 2 is in part a perspective view of an individual ion emitter unit of the system of FIG. 1 and in part a schematic circuit diagram of the low voltage power supply and timing signal circuit of the apparatus.

In particular, the emitter units 13, control console 14 and feedback module 17 may each be similar to the corresponding components of the apparatus previously described with respect to FIGS. 1 to 3. A sensing resistor 139 is provided in the return current flow path from the high voltage supplies 24 and 26 to ground conductor 46 and a capacitor 141 is connected in parallel with the resistor. Any change in the ion output rate at an electrode 24 or 26 then causes a change in the return current voltage drop across resistor 139 and a change in the rate at which capacitor 141 charges during each period of ion generation.

The voltage on capacitor 141 may be sensed between a terminal 142 and the ground conductor 46, the terminal 142 being situated between resistor 139 and the high voltage supplies 28 and 29. The voltage at terminal 142 is transmitted to the feedback module 17 in place of the ion sensor signal of the previously described embodiments. In particular, terminal 142 is connected to the positive input of the D.C. level shifting amplifier 84 of FIG. 3. Referring again to FIG. 5, the system then varies the periods of positive and negative ion generation in the manner previously described but in response to changes in ion production at the electrodes rather than to changes of ion content in the air at the work site. Such a system is designed to stabilize the output of the emitter unit 13 which can otherwise vary over a period of time from such causes as electrode deterioration, line voltage fluctuations or the like.

Figures 5, 6:
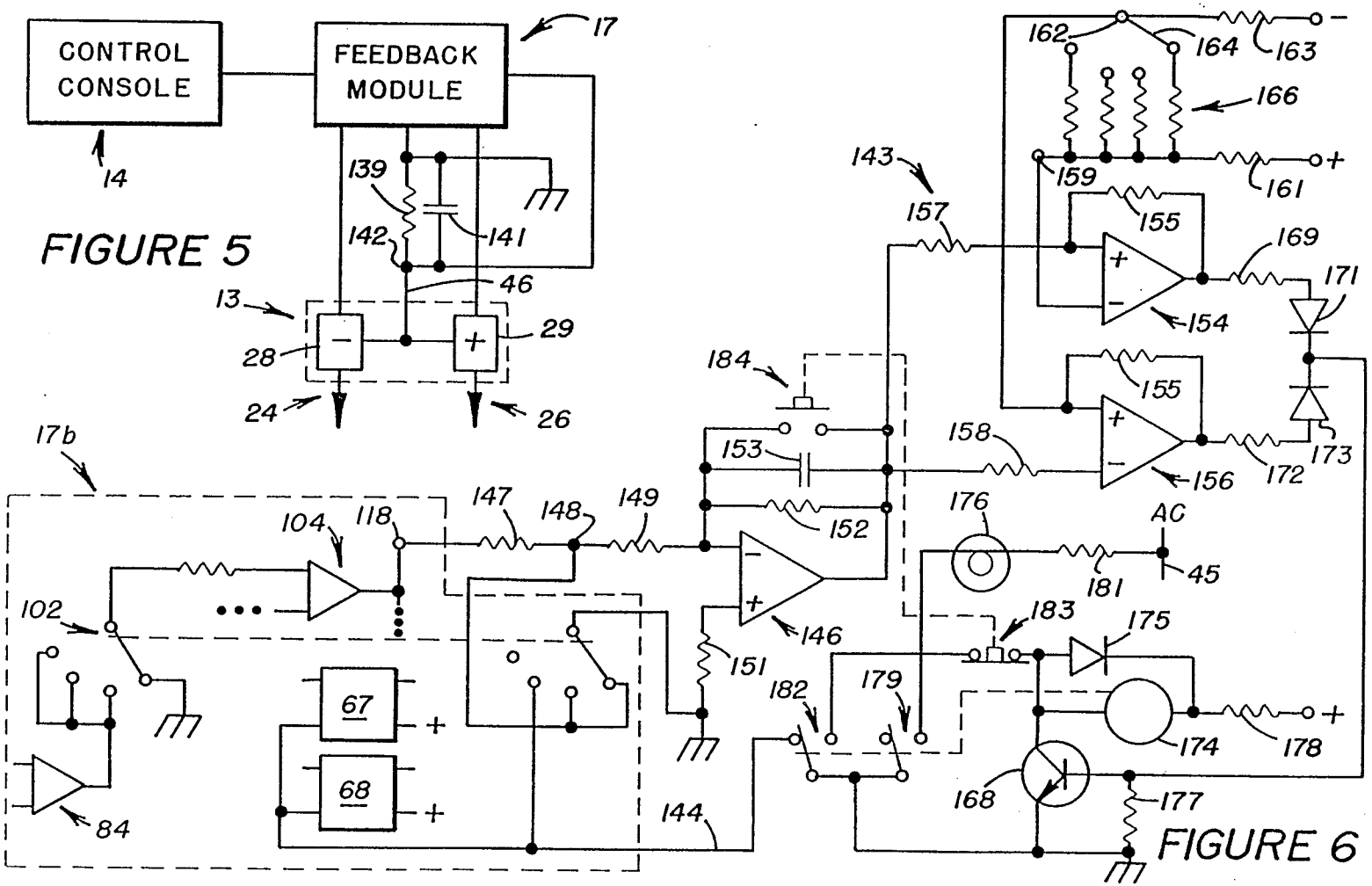
FIG. 5 is a schematic circuit diagram of another embodiment which stabilizes the ion output rate of an air ionizer.
FIG. 6 is a circuit diagram of an alarm and shut-off circuit which may be coupled to the apparatus of the preceeding figures.

Referring now to FIG. 6, an alarm and shutdown circuit 143 may be coupled to the circuit of FIG. 3 to provide a warning signal if the feedback signal indicates that the positive or negative ion concentration in the air has departed from a predetermined selectable range. The circuit 143 has a further optional mode of operation that automatically shuts down the apparatus, in addition to providing a warning signal, if either ion concentration is outside the predetermined limits.

The feedback module 17*b* is made compatible with the alarm circuit 143 by utilizing a mode selector switch 102*b* that is a two pole switch having four positions and by replacing the permanent ground connections at the driver circuits of relays 67 and 68 with a conductor 144 that connects with the alarm circuit in a manner to be hereinafter described. Feedback module 17*b* may otherwise have the construction previously described with reference to FIG. 3.

Referring again to FIG. 6, the first or feedback off position of mode selector switch 102*b* and the second or feedback on position are similar to those previously described. At the on position, the feedback signal from D.C. level shifting amplifier 84 is transmitted to amplifier 104 as before. Switch 102*b* continues to transmit the feedback signal to amplifier 104 at each of the third and fourth switch positions which are, respectively, a feedback plus alarm position and a feedback with both alarm and shutdown position.

The signal taken from the output of amplifier 104 at terminal 118 is transmitted to the negative or inverting input of an integrating amplifier 146 through a resistor 147, circuit junction 148 and another resistor 149. A resistor 151 connects the positive input of amplifier 146 to ground. A resistor 152 and capacitor 153 are connected in parallel across the negative input and the output of integrator amplifier 146 to establish sizable time constant, which time constant exceeds the time that elapses between successive ones of the ion generation periods and which is 500 seconds in this example. Consequently, the alarm and shutdown circuit 143 does not respond to abnormal signal fluctuations that are of only brief duration.

The output signal voltage from integrator amplifier 146 is monitored by a pair of amplifiers 154 and 156 having feedback resistors 155 connected across the outputs and positive inputs and each of which operates as a comparator. Amplifiers 154 and 156 detect changes in the ratio of positive to negative ions in the air which exceed a predetermined range of ratios and which indicate that the apparatus is not maintaining the air ion content within the prescribed limits. In particular, comparator amplifier 154 detects an excess of positive ions and amplifier 156 detects an excess of negative ions.

The output of integrator amplifier 146 connects with the positive input of comparator 154 through resistor 157 and to the negative or inverting input of comparator 156 through another resistor 158. A selectable positive reference voltage is applied to the negative input of comparator 154 to enable selection of the positive voltage level on integrator capacitor 153 that will trigger the alarm circuit. A selectable negative reference voltage is applied to the positive input of comparator 156 to determine the level of negative voltage on capacitor 153 that triggers the alarm.

In particular, the negative input of comparator 154 connects to the positive D.C. power supply terminal through a circuit junction 159 and resistor 161. The positive input of the other comparator 156 is connected to the negative power supply terminal through another circuit junction 162 and another resistor 163. A four position switch 164 enables connection of any selected one of four different valued resistors 166 between circuit junctions 159 and 162.

Thus resistors 161, 163 and 166 jointly form an adjustable voltage divider. Resetting of the switch 164 to increase the resistance between circuit junctions 159 and 162 causes the reference voltages at comparators 154 and 156 to respectively become more positive and more negative. Reducing the resistance reduces the difference between the two reference voltages. Thus the levels of positive or negative voltage on capacitor 153 that turn on the comparators 154 and 156 can be jointly increased or decreased to define any of four different ranges of operating voltage.

The outputs of both comparators 154 and 156 are coupled to the base of an NPN transistor 168, through a resistor 169 and diode 171 in the case of comparator 154 and through another resistor 172 and diode 173 in the case of comparator 156. The transistor 168 becomes conductive during periods when the output of either comparator 154 or 156 has switched to the high state as the base of the transistor is connected to ground through a resistor 177 and the emitter is connected directly to ground.

Conduction through transistor 168 energizes a relay driver 174 as the collector of transistor 168 is connected to the positive D.C. power terminal through the relay driver and a current limiting resistor 178. A diode 175 connected in parallel with relay driver 174 protects the transistor 168 from voltage transients. Energizing relay driver 174 closes a first set of normally open relay contacts 179 to ground one side of an alarm signaling device 176. This actuates the alarm signal as the other side of the device 176 is connected to alternating current conductor 45 through a current limiting resistor 181.

Signaling device 176 is a warning lamp in this embodiment of the invention but may also be of other forms such as a bell or buzzer for example.

A second set of relay contacts 182 have a normally closed position which grounds the conductor 144 from the driver circuits of feedback module relays 67 and 68 thereby enabling operation of relays 67 and 68 in the manner previously described. Energizing the alarm relay driver 174 switches contacts 182 to an alternate position at which the contacts no longer provide a ground connection for the relays 67 and 68. This shuts down the ion generation process, if mode selector switch **102*b* is in its fourth position, as the normally open relays 67 and 68 can no longer be closed. Shut down does not occur if mode selector switch 102*b* is at any other position. At the second or feedback on position, mode selector switch 102*b* grounds circuit junction 148 thereby inactivating the alarm and shut down circuit 143 as the feedback signal is diverted from amplifier 146. Switch 102*b* grounds conductor 144 at the third or feedback plus alarm position and thus the relays 67 and 68 remain closable without regard to the setting of relay contacts 182**.

At the operated position, relay contacts 182 ground the collector of transistor 168 through a first set of normally closed reset switch contacts 183. This stops conduction through the transistor 168 but also latches relay driver 174 in the energized condition. Thus the alarm signaling device 176 continues to operate until such time as the reset switch contacts 183 are manually opened.

Reset switch contacts 183 operate jointly with another set of reset switch contacts 184 which are normally open and which are connected in parallel with the integrator capacitor 153 of integrating amplifier 146. Thus operation of the reset switch contacts 183 and 184 deactuates the alarm relay driver 174 and discharges the signal integrating capacitor 153 enabling a new period of operation of the system to begin.

Figure 7:
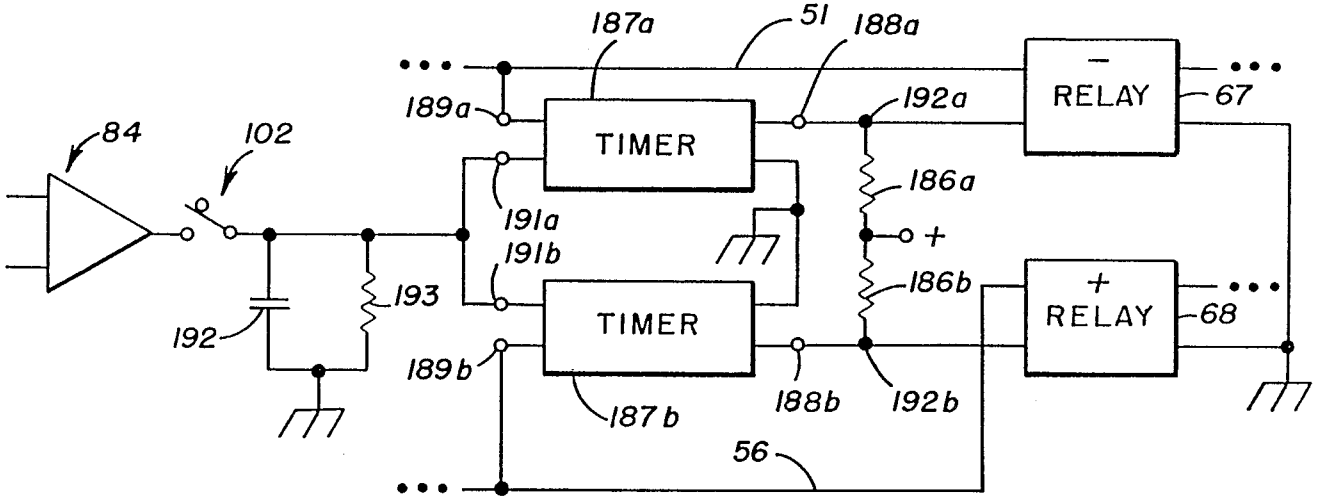
FIG. 7 is a circuit diagram of a modified form of feedback circuit for the ionizing apparatus.

The particular embodiment of the feedback module which has been described with reference to FIG. 3 varies the duration of ion generation periods by terminating the periods prior to the times that the timing signals at the control console would otherwise end such periods. Varying the durations of the ion generation periods in response to the feedback signals can also be done by delaying actual ion generation during the initial portions of the fixed ion generation periods defined by the timing signals or by suppressing ion generation for an interval during the middle of each such period. A modified feedback module **17*c* which enables these modes of operation is shown in FIG. 7**.

The feedback module **17*c* may be similar to that previously described except for the components which are connected between the D.C. level shifting amplifier 84 and the relays 67 and 68 for the purpose of alternately energizing the relays. Relay 67 and 68 are of the normally closed type in this embodiment and positive D.C. voltage is applied to the driver circuit of each relay through resistors 186*a* and 186*b* respectively. Relay 67 is operated by a voltage controlled timing circuit 187*a* of the known form which has an output terminal 188*a* at which voltage goes low, in response to receipt of a trigger voltage at a trigger terminal 189*a*, for a period of time that is dependent on the voltage applied to a control terminal 191*a*. Output terminal 188*a* is connected to the circuit junction 192*a* between resistor 186*a* and relay 67 and thus the low condition at terminal 188*a* reduces current through the driver circuit of relay 67 causing the relay to open. The trigger terminal 189*a* is connected to cable conductor 51 and thus the timing circuit is triggered each time that current for actuating the negative high voltage generator is transmitted by the control console. Actual generation of negative ions in response to the current is delayed until timing circuit terminal 188*a* reverts to the high condition enabling closing of relay 67**.

The feedback signal from D.C. level shifting amplifier 84 is transmitted to the voltage control terminal **191*a* of timing circuit 187*a* through mode control switch 102 and an integrator formed by a capacitor 192 and resistor 193 each of which is connected between terminal 191*a* and chassis ground. Thus the delay period before negative ion production which begins in response to each current pulse on cable conductor 51** is dependent on the magnitude of the feedback signal voltage at the time. The delay increases, reducing negative ion output, when the feedback signal indicates an increase in negative ion content in the air and decreases to increase ion output when the signal indicates a reduction of negative ion content.

Relay 68, which transmits periodic actuating current to the positive high voltage generator, is controlled in the same manner by a similar timing circuit 187*b*. Timing circuit 187*b* has a trigger terminal 189*b* connected to the other cable conductor 56 that provides periodic actuating current for the positive high voltage generator. The output terminal 188*b* of timing circuit 187*b* is coupled to the circuit junction 192*b* between resistor 186*b* and the relay 68 and the integrated feedback signal from amplifier 84 is transmitted to the control terminal 191*b*. Thus timing circuit 187*b* acts to introduce a variable delay into the periods of positive ion generation in the manner described above with respect to the negative side of the circuit and functions in a similar manner to regulate the positive ion content of the air.

If timing circuits 187*a* and 187*b* are of the type which exhibit a delayed response to trigger signals, the circuits still accomplish the desired result. In this case, the timing circuits 187*a* and 187*b* temporarily interrupt the fixed periods of ion generation that are called for by the control console instead of suppressing ion production during the initial portions of such periods.

The invention has been herein described with respect to apparatus 11 designed for electrostatic charge suppression. The method and apparatus can also be used in air ionizing operations for other purposes such as air purification for example. Air ions impart charge to particles of dust, pollen, smoke or the like. Electrostatic attraction then causes such particles to be deposited on nearby surfaces. The invention is also adaptable to ionizing operations where ions of only one polarity are produced. Ionizers for freshening the air in a room typically produce only negative ions as ions of that particular polarity have beneficial physiological effects.

While the invention has been described with respect to certain specific embodiments for purpose of example, many variations in the method and in the apparatus are possible and it is not intended to limit the invention except as defined in the following claims.

We claim:

1. In apparatus for maintaining the ion content of the atmosphere at a predetermined location within a predetermined range, the combination comprising:

at least one ionizing electrode, timing means for generating a cyclical first timing signal that alternates between first and second signal conditions at a predetermined fixed rate, means for applying a sustained direct current high voltage of a predetermined polarity to said electrode during cyclical ion generation periods that occur while said timing signal is in said first signal condition and for at least reducing the voltage on said electrode to suppress production of ions by said electrode when said first timing signal is in said second signal condition, sensing means for producing a feedback signal that is indicative of variations of the concentration of ions of said predetermined polarity at said location, feedback means for suppressing ion production by said electrode for an interval during said periods of ion generation and for increasing the duration of the intervals of ion generation suppression when said feedback signal indicates an increase in the concentration of ions of said predetermined polarity at said location and for decreasing the duration of the intervals of ion generation suppression when said feedback signal indicates a decrease in the concentration of ions of said predetermined polarity at said location to maintain said ion content at said location within said predetermined range, a signal integrator coupled to said sensing means and receiving said feedback signal therefrom, said signal integrator having a time constant which exceeds the time that elapses between successive ones or said ion generation periods, an alarm signaling device, and means for actuating said signaling device when the output signal from said signal integrator departs from a predetermined range of values.

2. In apparatus for maintaining the ion content of the atmosphere at a predetermined location within a predetermined range, said apparatus having at least one ionizing electrode, timing means for generating a cyclical first timing signal that alternates between first and second signal conditions, means for applying high voltage of a predetermined polarity to said electrode during cyclical ion generation periods that occur while said timing signal is in said first signal condition and for at least reducing the voltage on said electrode during intervals that occur while said first timing signal is in said second signal condition, and sensing means for producing a feedback signal that is indicative of variations of ion concentration at said location, the improvement comprising:

feedback means for varying the duration of said periods of ion generation in response to variations of said feedback signal to maintain said ion content at said location within said predetermined range, a signal integrator coupled to said sensing means and receiving said feedback signal therefrom, said signal integrator having a time constant which exceeds the time that elapses between successive ones of said ion generation periods, an alarm signaling device, means for actuating said signaling device when the output signal from said signal integrator departs from a predetermined range of values, means for shutting down ion generation by said apparatus when said signal integrator output signal departs from a predetermined range of values, further including a reset switch coupled to said alarm signaling device and said signal integrator and having means for deactuating said alarm signaling device and for restoring said integrator output signal to a value within said predetermined range of values in response to actuation of said reset switch.

3. In a method of maintaining the ratio of positive to negative ions and the total concentration of ions in the atmosphere at a predetermined location within desired ranges, the steps comprising:

producing timing signals that define recurrent first time periods of fixed duration which alternate with recurrent second time periods of fixed duration, generating positive ions in the vicinity of said location during said first time periods and generating negative ions in the vicinity of said location during said second time periods, producing a cyclical feedback signal that varies during each of said time periods in response to the increasing positive ion concentration during said first time periods and in response to the increasing negative ion concentration during said second time periods, temporarily suppressing generation of ions of both polarities during said first and second time periods during intervals which are of less duration than said time periods, varying the duration of said intervals of ion generation suppression in response to said feedback signal during said first time periods to maintain the positive ion concentration at a desired value, and independently varying the duration of said intervals of ion generation suppression in response to said feedback signal during said second time periods to maintain the negative ion concentration at a desired value.

4. The method of claim 3 including the further steps of initiating positive ion generation at the start of each of said first time periods, terminating positive ion generation prior to the end of each of said first time periods when said feedback signal indicates that said ion concentration has reached a predetermined positive polarity, initiating negative ion generation at the start of each of said second time periods, and terminating negative ion generation prior to the end of each of said second time periods when said feedback signal indicates that said ion concentration has reached a predetermined negative polarity.

5. The method of claim 3 wherein said step of temporarily suppressing generation of ions during said first and second time periods is accomplished by delaying the generation of ions for said intervals during the initial portions of said time periods.

6. The method of claim 3 wherein said ions are generated at the beginnings and ends of said first and second time periods and said step of temporarily suppressing generation of ions during said time periods is performed by temporarily interrupting the generation of ions for said intervals during the intermediate portions of said time periods.

7. The method of claim 3 including the further step of producing said positive and negative ions at different locations including generating said positive ions at a first location during said first time periods and generating said negative ions at a second spaced apart location during said second time periods.

8. The method of claim 3 including the further step of suppressing generation of ions of both polarities for an additional fixed interval between each of said time periods and the following one of said time periods.

9. The method of claim 3 wherein said ions are generated by applying positive high voltage to at least one electrode during said first time periods and by applying negative high voltage to at least one electrode during said second time periods, including the further steps of:

increasing said positive high voltage when said feedback signal indicates a decrease of positive ion concentration and deceasing said positive high voltage when said feedback signal indicates an increase of positive ion concentration, and increasing said negative high voltage when said feedback signal indicates a decrease of negative ion concentration and decreasing said negative high voltage when said feedback signal indicates an increase of negative ion concentration.

10. The method of claim 3 wherein said ions are generated by applying high voltage to at least one ionizing electrode during said first and second time periods and wherein a return current flow from said electrode to ground varies as a function of the rate of ion generation at said electrode, including the further steps of:

producing said feedback signal by detecting variations of the magnitude of said return current flow, varying the duration of said intervals of ion generation suppression is correspondence with variations of said return current flow.

11. Apparatus for maintaining the ratio of positive to negative ions and the total concentration of ions in the atmosphere at a predetermined location within desired ranges, comprising:

timing means for generating timing signals that define recurrent first time periods that alternate with recurrent second time periods, ion generating means for generating positive ions in the vicinity of said location during said first time periods and for generating negative ions in the vicinity of said location during said second time periods, feedback means for producing a cyclical feedback signal that varies during each of said time periods and which is indicative of increases of positive ion concentration during said first time periods and which is indicative of increases of negative ion concentration during said second time periods, means for suppressing generation of ions of both polarities for a temporary interval during said first and second time periods, means for varying the duration of said intervals of suppression of generation of ions of both polarities in response to said feedback signal during said first time periods to maintain the positive ion concentration within a desired range, and means for independently varying the duration of said intervals of suppression of generation of ions of both polarities in response to said feedback signal during said second time periods to maintain the negative ion concentration within a desired range.

12. The apparatus of claim 11 wherein said ion generating means starts generating positive ions at the beginning of each of said first time periods and starts generating negative ions at the beginning of each of said second time periods, and wherein said means for suppressing ion generation for a temporary interval suppresses ion generation during a terminal portion of each of said time periods.

13. The apparatus of claim 11 wherein said means for suppressing ion generation for a temporary interval delays ion generation for an interval which occurs at the beginning of each of said first and second time periods.

14. The apparatus of claim 11 wherein said ion generating means starts generating positive ions at the beginning of each of said first time periods and starts generating negative ions at the beginning of each of said second time periods, and wherein said means for suppressing ion generation for a temporary interval suppresses ion generation during each time period for an interval which occurs after the beginning of the time period and which ends prior to the end of the time period.

15. The apparatus of claim 11 further including a return current resistor connected between said ion generating means and ground, and wherein said feedback means produces said feedback signal by detecting variations of the voltage drop across said resistor.

16. The apparatus of claim 11 wherein said ion generating means includes at least first and second spaced apart ionizing electrodes, a positive high voltage generator connected to said first electrode and a negative high voltage generator connected to said second electrode, each of said high voltage generators being of the direct current type which can be actuated to produce a continuous output voltage of a single polarity, and wherein said timing means actuates said positive high voltage generator and deactuates said negative high voltage generator during said first time periods and actuates said negative high voltage generator and deactuates said positive high voltage generator during said second time periods, and wherein said means for suppressing ion generation for a temporary interval deactuates said positive high voltage generator for an interval during said first time periods and deactuates said negative high voltage generator for an interval during said second time periods.

17. The apparatus of claim 16 further including:

means for varying the magnitude of the voltage produced by said positive high voltage generator in inverse relationship to changes in the positive ion concentration at said location as indicated by said feedback signal, and means for varying the magnitude of the voltage produced by said negative high voltage generator in inverse relationship to changes in the negative ion concentration at said location as indicated by said feedback signal.

18. In apparatus for maintaining the ion content of the atmosphere at a predetermined location within a desired range, the combination comprising:

at least one ionizing electrode for disposition in the vicinity of said location, a high voltage generator connected to said electrode and being of the direct current type which can be actuated to produce a sustained output voltage of a single predetermined polarity, means for producing a timing signal that alternates between first and second signal conditions at a predetermined fixed rate, control means for actuating said high voltage generator in response to changes of said timing signal from said second signal condition into and first signal condition to thereby initiate variable recurrent periods of generation of ions of said predetermined polarity and for deactuating said high voltage generator when said said timing signal is in said second signal condition to suppress production of ions of said predetermined polarity during the periods that said timing signal is in said second signal condition, feedback means for producing a cyclical feedback signal that varies during each of said recurrent periods of ion generation in response to variations of the concentration of ions of said predetermined polarity in the atmosphere at said location during each period, means for increasing the duration of said recurrent periods of ion generation when said feedback signal indicates a decreasing concentration of ions of said predetermined polarity at said predetermined location and for decreasing the duration of said recurrent periods of ion generation when said feedback signal indicates an increasing concentration of ions of said predetermined polarity at said location to maintain said ion content within said desired range.

* * * * *

UNITED STATES PATENT AND TRADEMARK OFFICE

CERTIFICATE OF CORRECTION

PATENT NO. : 4,951,172

DATED : August 21, 1990

INVENTOR(S) : Arnold J. Steinman and Michael G. Yost

It is certified that error appears in the above-identified patent and that said Letters Patent is hereby corrected as shown below:

Column 1, line 57, delete "Gehike" and insert --Gehlke--.

Column 3, line 23, delete "advantaqueous" and insert--advantageous--, line 57, after "periods" insert --.--.

Column 4, line 50, after "ions" insert -- . --, and delete "varying" and insert "Varying".

Column 9, line 61, after "a" delete "a".

Column 12, line 40, delete "!13" and insert --113--.

UNITED STATES PATENT AND TRADEMARK OFFICE

CERTIFICATE OF CORRECTION

PATENT NO. : 4,951,172

DATED : August 21, 1990

INVENTOR(S) : Arnold J. Steinment and Michael G. Yost

It is certified that error appears in the above-identified patent and that said Letters Patent is hereby corrected as shown below:

Claim 10, column 20, line 4, delete "is" and insert --in--.

Claim 18, column 22, line 8, after "into" delete "and" and insert --said--.

Signed and Sealed this

Twenty-fifth Day of February, 1992

*Attest:*

HARRY F. MANBECK, JR.

*Attesting Officer*

*Commissioner of Patents and Trademarks*